US006708435B2

(12) United States Patent
Massey

(10) Patent No.: US 6,708,435 B2
(45) Date of Patent: Mar. 23, 2004

(54) PLACARD HOLDER

(76) Inventor: Marshall T. Massey, 10848 S. Green St., Chicago, IL (US) 60601

( * ) Notice: Subject to any disclaimer, the term of this patent is extended or adjusted under 35 U.S.C. 154(b) by 0 days.

(21) Appl. No.: 10/186,519

(22) Filed: Jul. 1, 2002

(65) Prior Publication Data

US 2004/0000080 A1 Jan. 1, 2004

(51) Int. Cl.[7] ..... G09F 21/04
(52) U.S. Cl. ..... 40/643; 40/654.01; 40/661
(58) Field of Search ..... 40/643, 644, 654.01, 40/660, 661, 661.05

(56) References Cited

U.S. PATENT DOCUMENTS 4,240,543 A * 12/1980 McKee ..... 40/661
4,462,175 A * 7/1984 Romberger ..... 40/661
4,897,945 A * 2/1990 Webb ..... 40/649
D313,820 S * 1/1991 Wright ..... D19/90
D429,286 S * 8/2000 Luciani et al. ..... D20/42
6,151,823 A * 11/2000 Gregory-Gillman ..... 40/661

* cited by examiner

*Primary Examiner*—Gary Hoge
(74) *Attorney, Agent, or Firm*—Trexler, Bushnell, Giangiorgi, Blackstone & Marr, Ltd.

(57) ABSTRACT

A placard holder that includes a body portion and a hook portion extending from the body portion. The placard holder is configured to receive a placard, and the placard holder is configured such that the placard is viewable through the placard holder when the placard is received by the placard holder. Preferably, the placard holder is made of a relatively clear or transparent plastic, and the placard is slidable into the placard holder. Preferably, a side of the placard holder is configured to receive the placard or the top of the placard holder, including at least a portion of the hook portion, is configured to receive the placard. Preferably, the placard holder is configured such that the placard does not protrude from the placard holder once the placard is inserted in the placard holder. Hence, the placard holder fully protects the placard which is contained in the placard holder. The hook portion is configured to engage a rear view mirror of a vehicle such that the placard holder hangs.

10 Claims, 4 Drawing Sheets

PLACARD HOLDER

BACKGROUND

The present invention generally relates to placard holders, and more specifically relates to a placard holder configured to receive a placard, such as a placard which indicates the disability of a driver of a vehicle, and configured to hang from the rear view mirror of the vehicle.

There is a need for a lightweight, inexpensive placard holder which can receive and protect a placard and which can hang from the rear view mirror of a vehicle. One type of placard which should be protected is a disability placard, such as a placard which indicates that the driver of a vehicle is handicapped or disabled. Such a placard is used to enable the driver to park in a handicapped parking spot without either getting a ticket or getting towed. It is important to protect such a placard because if such a placard should get destroyed, it may be difficult or may take a long time to finally receive another one from whatever government authority or agency issues such placards. Additionally, it is important to protect such a placard to ensure that the placard can be hung from the rear view mirror of a vehicle as, in many jurisdictions, this is the proper location to display such a placard for law enforcement to see. It is important to provide that such a placard is not subject to harm whenever the placard is moved from one vehicle to another because many disabled drivers drive more than one vehicle and must continuously transport their disability placard from vehicle to vehicle.

OBJECTS AND SUMMARY

A general object of an embodiment of the present invention is to provide a placard holder which is configured to hang from the rear view mirror of a vehicle.

Another object of an embodiment of the present invention is to provide a placard holder which is inexpensive.

Still another object of an embodiment of the present invention is to provide a placard holder which is lightweight.

Yet another object of an embodiment of the present invention is to provide a placard holder which is durable.

Still yet another object of an embodiment of the present invention is to provide a placard holder which is generally see-through and is configured to receive a placard such that the placard is viewable through the placard holder.

Briefly, and in accordance with at least one of the foregoing objects, an embodiment of the present invention provides a placard holder that includes a body portion and a hook portion extending from the body portion. The placard holder is configured to receive a placard, and the placard holder is configured such that the placard is viewable through the placard holder when the placard is received by the placard holder. Preferably, the placard holder is made of a relatively clear or transparent plastic, and the placard is slidable into the placard holder. Preferably, either a side or the top of the placard holder is configured to receive the placard. Preferably, the placard holder is configured such that the placard does not protrude from the placard holder once the placard is inserted in the placard holder. Hence, the placard holder fully protects the placard which is contained in the placard holder. The hook portion is configured to engage a rear view mirror of a vehicle such that the placard holder hangs.

BRIEF DESCRIPTION OF THE DRAWINGS

The organization and manner of the structure and operation of the invention, together with further objects and advantages thereof, may best be understood by reference to the following description, taken in connection with the accompanying drawings, wherein.

DESCRIPTION

Figure 1:
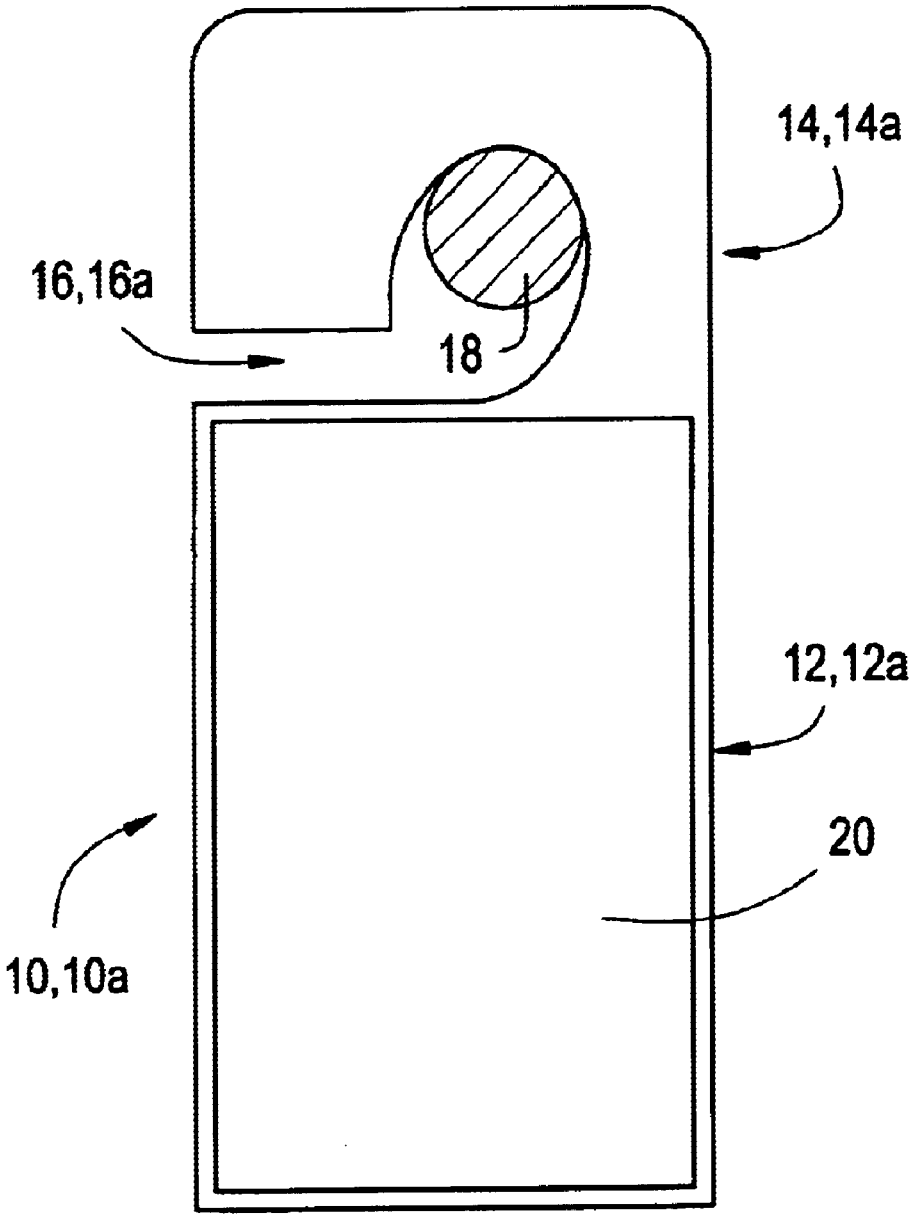
FIG. 1 is a front elevational view of a placard holder which is in accordance with the present invention.
Figure 2:
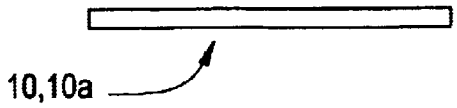
FIG. 2 is a top plan view of the placard holder shown in FIG. 1.
Figure 3:
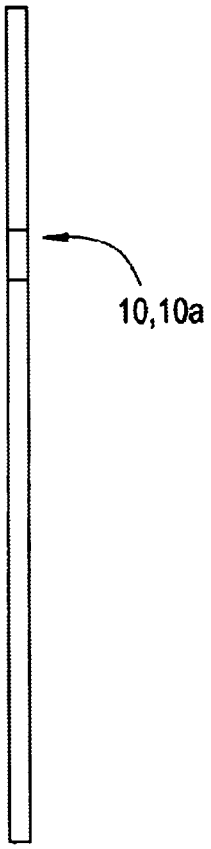
FIG. 3 is a left side elevational view of the placard holder shown in FIG. 1.
Figure 4:
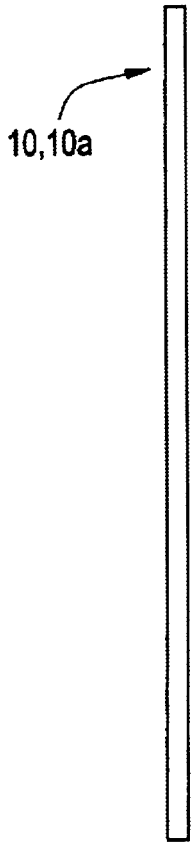
FIG. 4 is a right side elevational view of the placard holder shown in FIG. 1.
Figure 5:
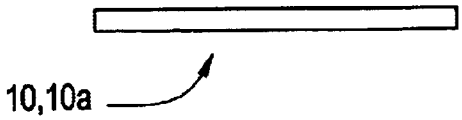
FIG. 5 is a bottom plan view of the placard holder shown in FIG. 1.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

FIGS. 1–6 depict a placard holder 10, 10*a* which is in accordance with either a first or second embodiment of the present invention depending on where an opening for a placard is formed. Specifically, FIG. 1 depicts a placard holder 10, 10*a* which either has an opening along its side or along its top. Regardless of where the opening for the placard is formed, the placard holder 10, 10*a* is configured to receive a placard and hang from the rear view mirror of a vehicle. Additionally, the placard holder is inexpensive lightweight, durable and is configured such that the placard is viewable through the placard holder.

Figure 6:
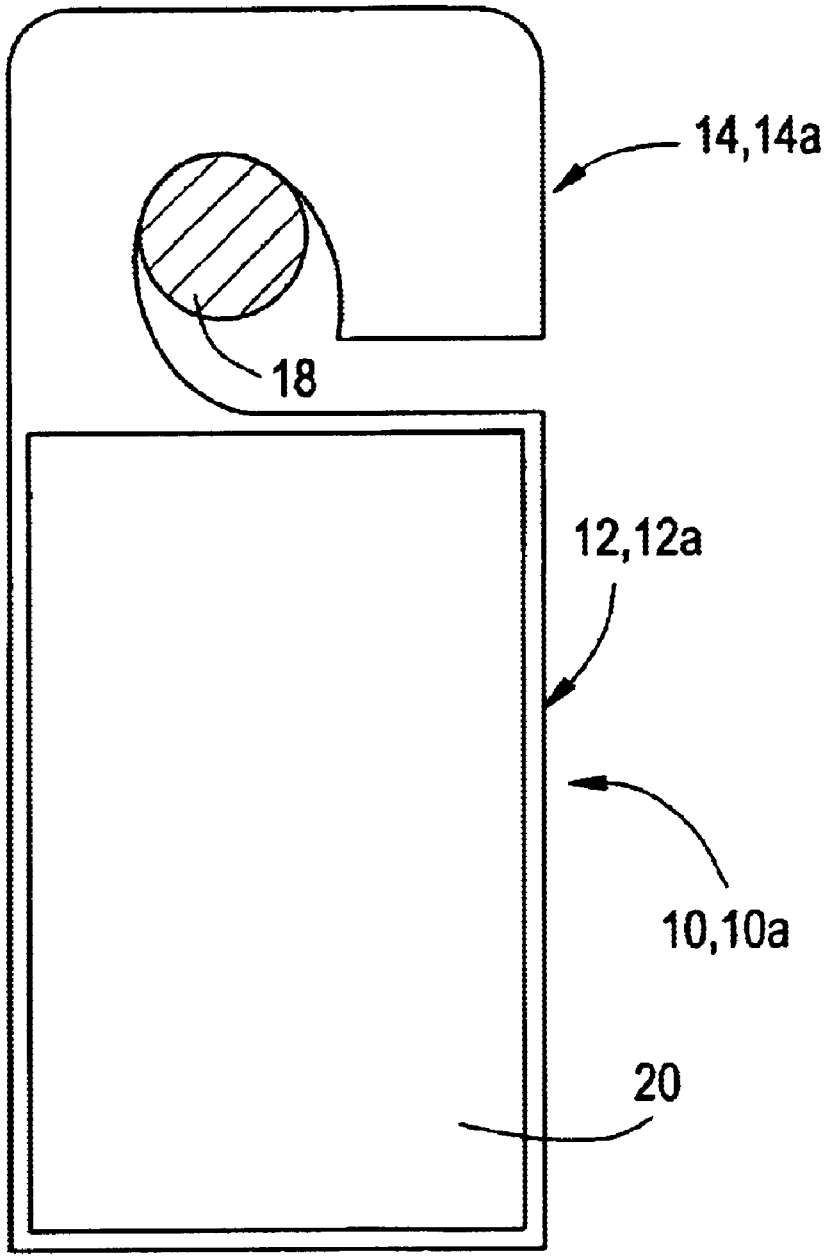
FIG. 6 is a rear elevational view of the placard holder shown in FIG. 1.

As shown in FIGS. 1 and 6, the placard holder 10, 10a includes a body portion 12, 12*a* and a hook portion 14, 14*a* which extends generally upward from the body portion 12, 12*a*. The hook portion 14, 14*a* includes a cut out 16, 16*a* which provides that the hook portion 14, 14*a* can be engaged with the rear view mirror of a vehicle. Specifically, both FIGS. 1 and 6 depict a cross-sectional view of an arm 18 of a rear view mirror. As shown, the cut out 16, 16*a* in the placard holder 10, 10*a* receives the arm 18 of the rear view mirror such that the hook portion 14, 14*a* of the placard holder 10, 10*a* hangs on the arm 18. As such, the placard holder 10, 10*a* is hangable from the rear view mirror of a vehicle and it is the cut out 16, 16*a* which provides as such.

The placard holder 10, 10*a* includes an opening or gap for receiving a placard 20, such as a placard for indicating the disability of the driver of a vehicle. Such a placard 20 can be, for example, rectangular as shown in FIGS. 1 and 6–8. Preferably, the placard holder 10, 10*a* consists of a relatively lightweight plastic film which is not bonded together along at least a portion of its edge to provide the gap or opening for receiving the placard 20. Preferably, the placard holder 10, 10*a* is clear or at least semi-transparent such that the placard 20 can be viewed from outside the placard holder 10, 10*a* once the placard 20 is contained therein.

Figure 7:
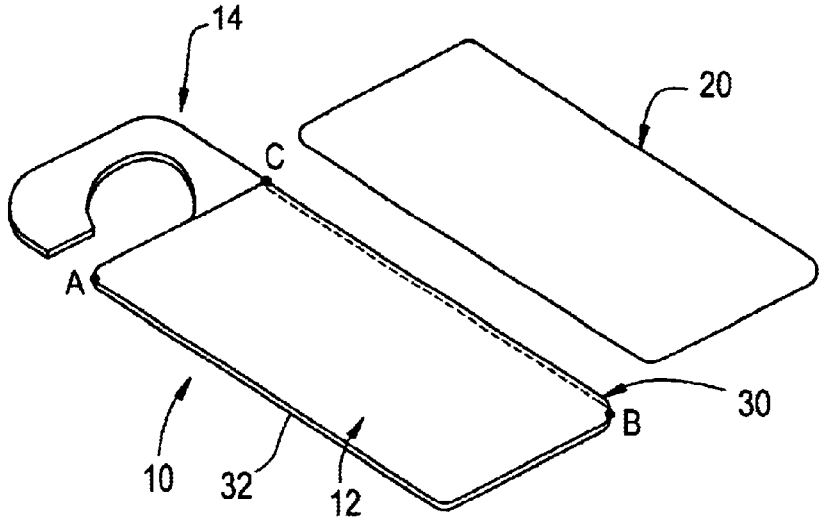
FIG. 7 is a perspective view of a placard holder which is in accordance with a first embodiment of the present invention, showing a placard being slid into the placard holder from the side.

One possibility for providing such a gap or opening for receiving a placard is shown in FIG. 7, and provides that the placard holder 10 is bonded along its edge going counter-clockwise from point "A" to point "B", but is not bonded from point "B" upward to point "C". This provides that a gap or opening 30 for receiving a placard 20 is provided along the edge of the placard holder 10, going from point "C" downward to point "B". As such, the placard 20 can be inserted into the placard holder 10 from the side. In such case, preferably the front and back of the placard holder are bonded together at the hook portion 14, thereby providing that the hook portion 14 of the placard holder 10 is solid. Hence, the body portion 12 of the placard holder 10 includes a gap or opening 30 along its edge such that a placard 20 can be inserted into the placard holder 10 from the side, and the hook portion 14 is solid thereby providing that the placard holder 10 can hang reliably from the arm 18 of a rear view mirror. Overall, the placard holder 10 may be, for example, 0.08 inches thick. Preferably, the placard holder 10 is just a couple of millimeters wider than the placard 20 such that the placard 20 does not protrude from the placard holder 10 when the placard 20 is contained in the placard holder 10. Once the placard 20 has been received by the placard holder 10, the placard 20 can be removed by holding the placard holder 10 with the opening 30 pointing toward the floor and giving the placard holder 10 a tap on edge 32 or giving the placard holder 10 a downward shake.

Figure 8:
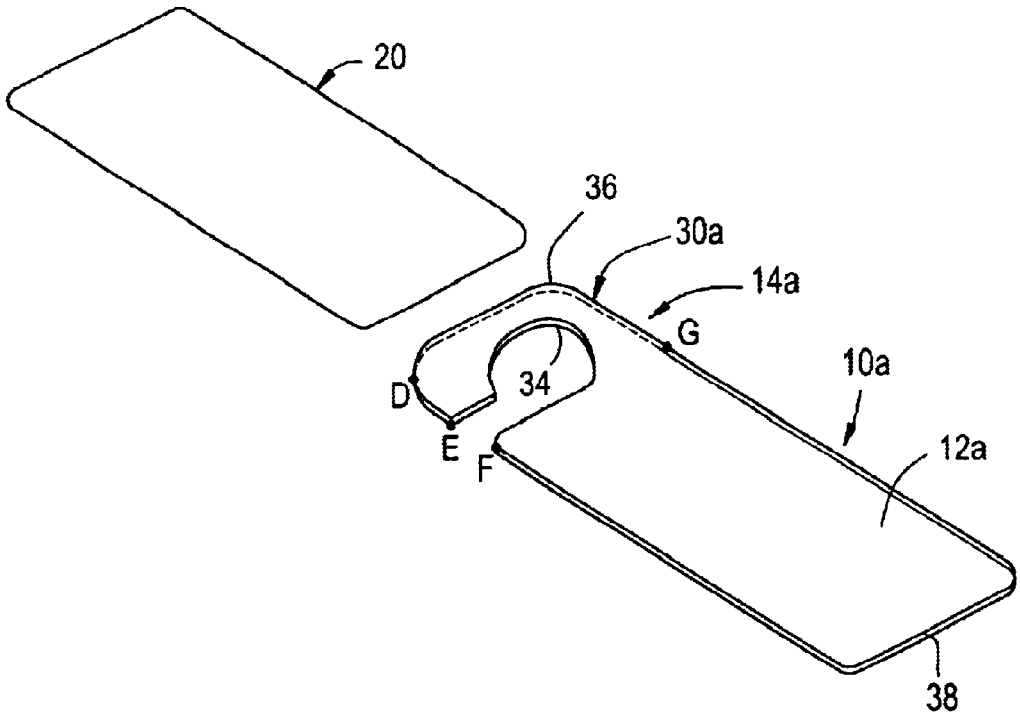
FIG. 8 is a perspective view of a placard holder which is in accordance with a second embodiment of the present invention, showing a placard being slid into the placard holder from the top.

Another possibility for providing a gap or opening for receiving a placard is shown in FIG. 8, and provides that the placard holder 10*a* is bonded at its edge going from point "D" downward to point "E", is not bonded along its edge going from point "E" downward (and along the edge 34 of the cut out 16*a*) to point "F", and is bonded along its edge from point "F" counter-clockwise to point "G". This provides that a gap or opening 30*a* for receiving a placard 20 is provided along the top 36 of the placard holder, generally at the hook portion 14*a*, from point "D" clockwise to point "G". Alternatively, the edge of the placard holder going from point "D" downward to point "E" may not be bonded in which case the gap or opening would be provided along the entire hook portion 14*a*, going from point "F" clockwise to point "G". Regardless, the configuration provides that essentially the entire placard holder 10*a* is hollow and that the placard 20 can be inserted into the placard holder 10*a* from the top. As a result of the entire placard holer 10*a* being hollow, the placard holder 10*a* may be shaped generally identical to the placard 20 itself (despite the fact that FIG. 8 shows the case where the placard 20 is rectangular). Overall, the placard holder 10*a* may be, for example, 0.08 inches thick having a 0.04 inch gap therein for receiving the placard. Preferably, the placard holder 10*a* is just a couple of millimeters wider than the placard 20 such that the placard 20 does not protrude from the placard holder 10*a* when the placard 20 is contained in the placard holder 10*a*. Once the placard 20 has been received by the placard holder 10*a*, the placard 20 can be removed by holding the placard holder 10*a* with the top 36 pointing toward the floor and giving the placard holder 10*a* a tap on its bottom edge 38 or by giving the placard holder 10*a* a downward shake.

Regardless of where the opening for the placard 20 is formed, the placard holder 10, 10*a* is configured to receive a placard 20 and hang from the rear view mirror of a vehicle. Additionally, the placard holder 10, 10*a* is inexpensive, lightweight, durable and is configured such that the placard 20 is viewable through the placard holder 10, 10*a*.

While embodiments of the present invention are shown and described, it is envisioned that those skilled in the art may devise various modifications of the present invention without departing from the spirit and scope of the appended claims.

What is claimed is:

1. A placard holder configured to receive a placard and be hanged from a rear view mirror of a vehicle, said placard holder comprising a first layer and a second layer overlying said first layer, said first layer and said second layer together comprising a body portion and a hook portion extending from the body portion, said hook portion configured to engage the rear view mirror such that the placard holder hangs therefrom, said placard holder configured such that the placard holder receives the placard between said first layer and said second layer and the placard is viewable through the placard holder when the placard is received by the placard holder wherein said first layer and said second layer, in said hook portions comprises first edges proximate an opening configured to receive the rear view mirror, said first edges being bonded together, said hook portion further comprising second edges and top edges which extends between the first edges and the second edges, said top edges and said second edges not being bonded together thereby defining an opening for receiving the placard.

2. A placard holder as recited in claim 1, wherein the placard holder is made of a relatively clear or transparent plastic.

3. A placard holder as recited in claim 1, wherein the placard holder is configured such that the placard is slidable into the placard holder.

4. A placard holder as recited in claim 1, wherein said placard holder is configured such that the placard does not protrude from the placard holder once the placard is inserted in the placard holder.

5. A placard holder configured to receive a placard and be hanged from a rear view mirror of a vehicle, said placard holder comprising a body portion and a hook portion extending from the body portion, said hook portion configured to engage the rear view mirror such that the placard holder hangs therefrom, said placard holder configured such that the placard holder receives tile placard and the placard is viewable through the placard holder when the placard is received by the placard holder, wherein said placard holder includes a top edge defined along an edge of the hook portion, said top edge configured to receive the placard, wherein the hook portion and body portion have equal width dimensions, wherein the hook portion is solid and the body portion is hollow and provides an opening for receiving the placard.

6. A placard holder as recited in claim 5, wherein the placard holder is made of a relatively clear or transparent plastic.

7. A placard holder as recited in claim 5, wherein the placard holder is configured such that the placard is slidable into the placard holder.

8. A placard holder as recited in claim 5, wherein said placard holder includes a side, said side configured to receive the placard.

9. A placard holder as recited in claim 5, wherein said placard holder is configured such that the placard does not protrude from the placard holder once the placard is inserted in the placard holder.

10. A placard holder as recited in claim 5, wherein at least a portion of an edge of the body portion is solid.

* * * * *

UNITED STATES PATENT AND TRADEMARK OFFICE

CERTIFICATE OF CORRECTION

PATENT NO. : 6,708,435 B2
DATED : March 23, 2004
INVENTOR(S) : Marshall T. Massey It is certified that error appears in the above-identified patent and that said Letters Patent is hereby corrected as shown below:

Column 4,
Line 42, “receives tile placard” should be -- receives the placard --

Signed and Sealed this

Eighth Day of June, 2004

JON W. DUDAS
*Acting Director of the United States Patent and Trademark Office*